United States Patent [19]

Meriwether

[11] Patent Number: 4,928,617

[45] Date of Patent: May 29, 1990

[54] MODULAR FLOAT DRUM SYSTEM

[75] Inventor: Jon D. Meriwether, Follansbee, W. Va.

[73] Assignee: The Louis Berkman Company, Steubenville, Ohio

[21] Appl. No.: 440,444

[22] Filed: Nov. 22, 1989

Related U.S. Application Data

[63] Continuation of Ser. No. 280,214, Dec. 5, 1988, abandoned, which is a continuation of Ser. No. 84,159, Aug. 12, 1987, Pat. No. 4,799,445.

[51] Int. Cl.[5] ..... B63B 35/00

[52] U.S. Cl. ..... 114/267; 114/266; 114/263

[58] Field of Search ..... 114/230, 263, 264, 266, 114/267, 256, 258, 44, 45, 68, 355, 357, 77 R, 77 A; 441/129; 405/218, 219; 52/578, 579

[56] References Cited

U.S. PATENT DOCUMENTS

| | | | |
|---|---|---|---|
| 3,752,102 | 8/1973 | Shuman | 114/0.5 F |
| 4,157,695 | 6/1979 | Knutsen | 114/267 |
| 4,365,577 | 12/1982 | Heinrich | 114/267 |
| 4,559,891 | 12/1985 | Shorter, Jr. | 114/263 |
| 4,655,156 | 4/1987 | Svirklys et al. | 114/266 |
| 4,709,647 | 12/1987 | Rytand | 114/267 |

FOREIGN PATENT DOCUMENTS

| | | | |
|---|---|---|---|
| 2351314 | 4/1975 | Fed. Rep. of Germany | 114/266 |

*Primary Examiner*—Joseph F. Peters, Jr.
*Assistant Examiner*—Clifford T. Bartz
*Attorney, Agent, or Firm*—Body, Vickers & Daniels

[57] ABSTRACT

Polyethylene float drums are constructed as modules, in various configurations, and then assembled into various modular systems to float a variety of structures. All float drum modules utilize at least one flat, perpendicular side wall to insure accurate assembly of the float drum modules into a flanged load bearing modular float assembly having desired float characteristics.

7 Claims, 9 Drawing Sheets

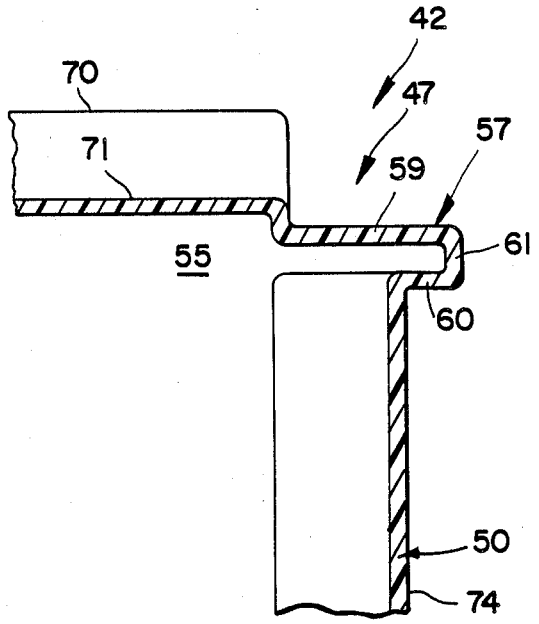
FIG. 6
FIG. 6a
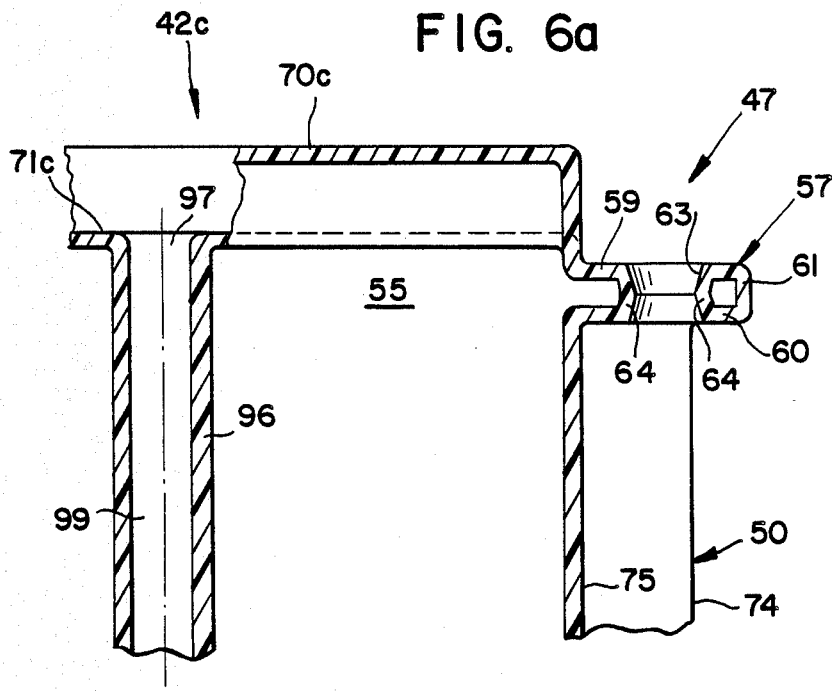

MODULAR FLOAT DRUM SYSTEM

This is a continuation, of Ser. No. 280,214, abandoned filed Dec. 5, 1988 which in turn is a continuation of Ser. No. 084,159 filed Aug. 12, 1987 now U.S. Pat. No. 4,799,445.

BACKGROUND

This invention relates generally to buoyant, float drums and more particularly to float drum modules and modular float drum assemblies produced thereby.

The invention is particularly applicable to a modular float drum assembly for use with floating docks, floating pipelines, swim floats and the like and will be described with particular reference thereto. However, it will be appreciated that the invention may have broader application and may be used to provide buoyancy to any structure desired to be floated in a liquid medium.

BACKGROUND OF THE INVENTION

Metal sealed drums have long been used to float docks, swim floats and other structures. While metal drums are relatively inexpensive, there are many problems and limitations present in their use as floats for various floating structures. For example, metal drums do not readily lend themselves for use as floats in the construction of sophisticated or intricate floating dock structures and the like. In addition, metal drums rust or deteriorate in either fresh or salt water and they are subject to corrosion or attack from gasoline, oil and other contaminants in the waterway and present a pollution hazard.

To alleviate some of these problems, foam flotation devices such as styrofoam floats, have been used in place of metal drums. However, foam flotation devices deteriorate when in contact with gasoline, oil and other contaminants present in the waterway. Further, foam flotation devices flake, or chip, when struck by or impacted with other objects which often occurs when they are used as flotation devices and the foam chips cause further pollution.

To overcome such problems, hollow polyethylene float drums of an especially configured shape have been developed for use as flotation devices for dock structures, swim floats and the like. An example of such a float drum is disclosed in U.S. Pat. No. 3,752,102 to Shuman, incorporated herein by reference. The polyethylene float drum illustrated in the Shuman patent and now marketed under the trademark "DAYTON", has an especially configured hollow plastic structure which does not lend itself to formation by conventional vacuum forming or blow-molding techniques, but can and is formed by a moving, die fusion-molding technique such as illustrated in U.S. Pat. Nos. 3,250,660 to Greig et al and 3,412,183 to Anderson et al, also incorporated by reference herein. Polyethylene drums manufactured by such process are chemically resistant to gasoline, oil, sea water, etc., have a high impact strength and show no signs of distortion or breakdown of material over a wide range of temperatures while exhibiting high buoyancy levels over extended periods of time. Further, the drums, when air filled, can be removed, drained and easily patched if punctured.

Importantly, polyethylene drums are molded with an integral, load bearing peripheral flange. The peripheral flange provides a means to secure the float drum to the support framework of the floating structure in an integral, inherently stable manner. Thus, a number of difficulties, in addition to those already mentioned concerning the use of steel drums and the like as water buoyant devices, such as dismantling the structure to take it in and out of the water, repairing the structure in the event of flotation leaks, assembling extensive floating structures, etc., are overcome when polyethylene float drums are used.

However, as the use of polyethylene float drums have increased, the sophistication and extensiveness of floating dock structures and the like and the supply of such structures in universal-type kit forms have, in turn, limited the application or feasibility of a floating dock structure to less than that which is possible by using the present invention. Such limitations, as will hereafter be explained, relate to stability of the structure, the maintenance of various sections of the structure at a relatively constant plane within the water, the ability of the structure to compensate for localized "dead weight" or varying "live" weight loadings, the availability of kits to make a widely dimensional variable structure supported by such float drums and cost considerations in purchasing, maintaining and assembling various floating structures.

Many such limitations arise, inherently, from the fact that the width of the walkway of the floating dock structure is limited to the length of the float drum. More specifically, in order for the float drum to provide a secure, stable float arrangement, the float drum should be tied to the structure about the entire periphery of its load support flange. If a wide dock section were desired so that one float drum was placed at one side of the dock, and one float drum was placed at the other side of the dock with a space therebetween, an unstable dock section would result. The unstability is attributed to the ripple effect resulting from the action of waves passing, unbroken, through the gap or space between the float drums resulting in high stresses tending to dislocate the float drums from the structure and transmitted to the dock structure itself tending to cause the structure to yew or pitch from side to side. The condition is aggravated by the size of the space between the floats and limits the width of the dock section which can be built using conventional polyethylene float drums. To some extent, the problem can be partially corrected by providing a more expensive dock structure utilizing additional stringers and cross-bracing to totally encapsulate each float drum, but this is not a satisfactory solution from a cost standpoint. An alternative solution is to design longer drum floats to span the dock's width, but this solution is also expensive and presents inventory control problems.

SUMMARY OF THE INVENTION

Accordingly, it is a principal object of the invention described herein to provide a polyethylene float drum and a float drum assembly which is an improvement over the standard polyethylene float drum described above.

This object, along with other features of the invention, is achieved by the use of at least two float drum modules secured as an assembly within a structure to be floatingly suspended in a body of water. More precisely, the modular assembly comprises at least two end drum modules and, depending on the structure's design, any number of intermediate float drum modules. Each drum module has a top wall, a bottom wall and contiguous first, second, third and fourth side walls extending between the top and the bottom walls to define a buoyant enclosure. In addition, each drum has a load bearing, rigidizing side flange at opposite sides of the drum's top wall. In turn, each flange has a generally flat top wall section, a generally flat bottom wall section and a contiguous edge wall section at the end of the flange's top and bottom wall sections to provide a space therebetween with the first side wall of the drum spaced inwardly from the edge wall section of one of the flanges and contiguous with the bottom wall section of that flange while the second side wall is similarly positioned with respect to the other side flange. The double wall construction provides a very rigid side mounting flange for each float drum module. The float drum modules, when arranged in a modular float drum assembly, will always include at least two end float drum modules. Each end float drum module, in addition to the two side flanges, has an end flange contiguous with ends of the side flanges and with the third side wall so that when the end drums are abutted together or when intermediate float drum modules are positioned in between the end float drum modules, a contiguous load bearing, double walled flange surrounds the entire periphery of the modular assembly to provide a smooth, continuous, rigid and flat surface for mounting the cross-bracing and the stringers associated with the desired structure thereto.

The fourth side wall of the end float drum modules and the third and the fourth side walls of the intermediate float drum modules are flat surfaces so that each drum can be tightly positioned against an adjacent drum with the flat side wall surface in co-planar relationship with one another to provide a stable assembly. Fastening surfaces are provided on the float drum modules so that the drums can be rigidly secured to one another to effect the desired co-planar relationship while at the same time permitting easy assembly and disassembly of the modular assembly. Preferably the fastening surfaces comprise ribs approximately extending the depth of each float drum module providing an additional flat bearing surface for maintaining the desired co-planar relationship while also functioning as an unyieldable area for mounting the fasteners.

In accordance with another aspect of the invention, the width of the structure, typically a floating dock furnished in kit form, is defined by at least a first and a second longitudinally extending stringer. On the top of and secured to the stringers are wooden slats which define the walkway. The modular float drum assembly, as explained above, spans the distance between the stringers (the dock width) at various longitudinal increments with the end flange of one end float drum module secured to the bottom of one stringer while an end flange of the second end float drum module is secured to the bottom of the opposite stringer. The space between the end float drum modules is then filled in or taken up by intermediate float drum modules. Cross-braces between the stringers are then attached to the side flanges of the float drums to encapsulate the modular float drum assembly while rigidizing the entire structure. In this manner, the modular float drum assembly provides a full face float structure beneath the stringers to achieve a "break wall" effect reducing the stresses which would otherwise be imparted to the float drums and the dock structure by the wave action passing through the space between the prior art drum floats while providing better stability to the dock structure resisting yewing or tipping thereof. By selectively dimensioning the float drum modules, a full width modular float drum assembly can be provided for any desired dock width by using the float drum modules of this invention.

In accordance with another aspect of the invention, the float drum modules described herein are either air filled or filled with a buoyant material such as styrofoam. The weight of each drum is approximately 15–20 pounds depending on whether the drum is air filled or foam filled. The dimensions of the float drum modules are approximately two feet long by two feed wide by one and one-half feet deep. At such weight and dimension, the float drum modules can be shipped parcel post as individual packages at a freight cost, for a complete modular float drum assembly, less than one-half that which it now costs to ship conventional polyethylene float drums by motor freight.

In accordance with another aspect of the invention, the depth of the intermediate drum modules may be less than the depth of the end drum modules. Alternatively, the depth of the third and fourth flat wall surfaces of the intermediate float drum modules can be maintained at the same height as that of the flat side wall of the end float drum module and the bottom wall of the intermediate float drum module can then be configured, such as in a concave direction, to reduce the depth of the intermediate float drum module at its midpoint. With either configuration, the modular float drum assembly has thick sections at its ends and a thin section at its midpoint so that the float spans the width of the dock structure to achieve the "break wall" effects noted above while also providing additional buoyancy at the ends of the dock width to avoid the slat ends dipping into the water from live loads placed at the edge of the dock.

In accordance with another aspect of the invention, the top wall of each drum module is provided with a plurality of ribs extending from side flange to side flange at consistent, repeated spaced intervals from one end to the other end of the float drum modules. The bottom wall of the drum module is similarly configured, preferably with the bottom wall ribs offset one spaced interval from the ribs in the It is another object of the invention to provide a modular float drum assembly which permits construction of a float configuration which can provide for additional buoyancy at select areas of the structure to compensate for additional dead or live weight loadings placed on the structure.

It is another object of the invention to provide a modular float drum assembly made up of float drum modules of a predetermined size and configuration to permit inexpensive shipment of float drum modules as parcel packages.

It is still another object of the invention to provide a modular float drum assembly which provides for an increase in stability of the floating structure supported by the modular float drum assembly than that heretofore provided.

It is another object of the present invention to provide a modular float drum assembly used to float various sections of an interconnected structure at the same elevation in the water.

It is yet another object of the invention to provide a modular float drum assembly which is tied to a multi-section floating structure in a manner which rigidizes each structural section while stabilizing the entire structure.

It is yet another feature of the invention to provide a universal floating dock kit and other floating structure kits utilizing a modular float drum assembly.

It is still another object of the invention to provide a modular float drum assembly which can be easily assembled with conventional tools.

It is still yet another object of the invention to use float drum modules to form a float drum assembly to buoyantly support a given portion of a structure and then use a plurality of such assemblies as modular assemblies to float the entire structure.

It is yet another object of the present invention to provide inexpensive float drum modules and float drum assemblies, per se and in combination with various floating structures secured thereto, which is inexpensive and easy to assemble.

Yet another object of the invention is to provide a modular float drum assembly which functions as a break wall to dissipate wave impact.

Still yet another object of the invention is to provide a float drum assembly made up of float drum modules which, when fastened together into an assembly provides a contiguous load bearing flange for supporting structural weight.

A still further object of the invention is to provide polyethylene float drum modules especially configured with rigid wall sections tied into one another to provide a strong rigid, impact resistant structure.

Other objects and advantages of the invention will appear from a study of the physical form that the invention may take in certain parts and arrangement of parts, preferred and alternative embodiments of which will be described in detail herein and illustrated in the accompanying drawings which form a part hereof.

BRIEF DESCRIPTION OF THE DRAWINGS

In the drawings:

FIGS. 6 and 6*a* are further enlarged partial cross-sectional views illustrating the flange construction of a float drum module;

DESCRIPTION OF THE PREFERRED EMBODIMENT

Figure 1:
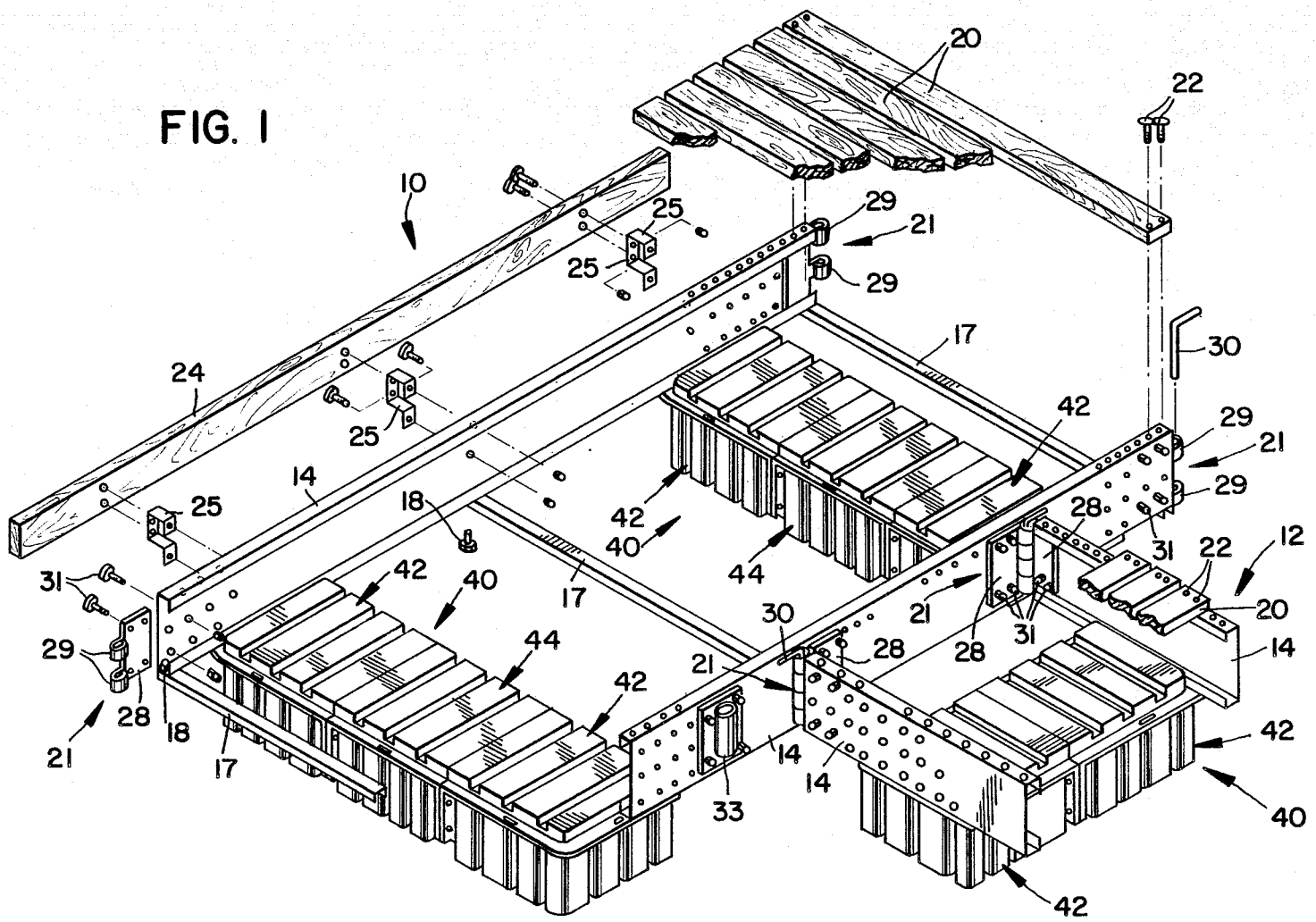
FIG. 1 is an exploded perspective view of a floating dock section with a modular float drum assembly secured thereto.
Figure 2:
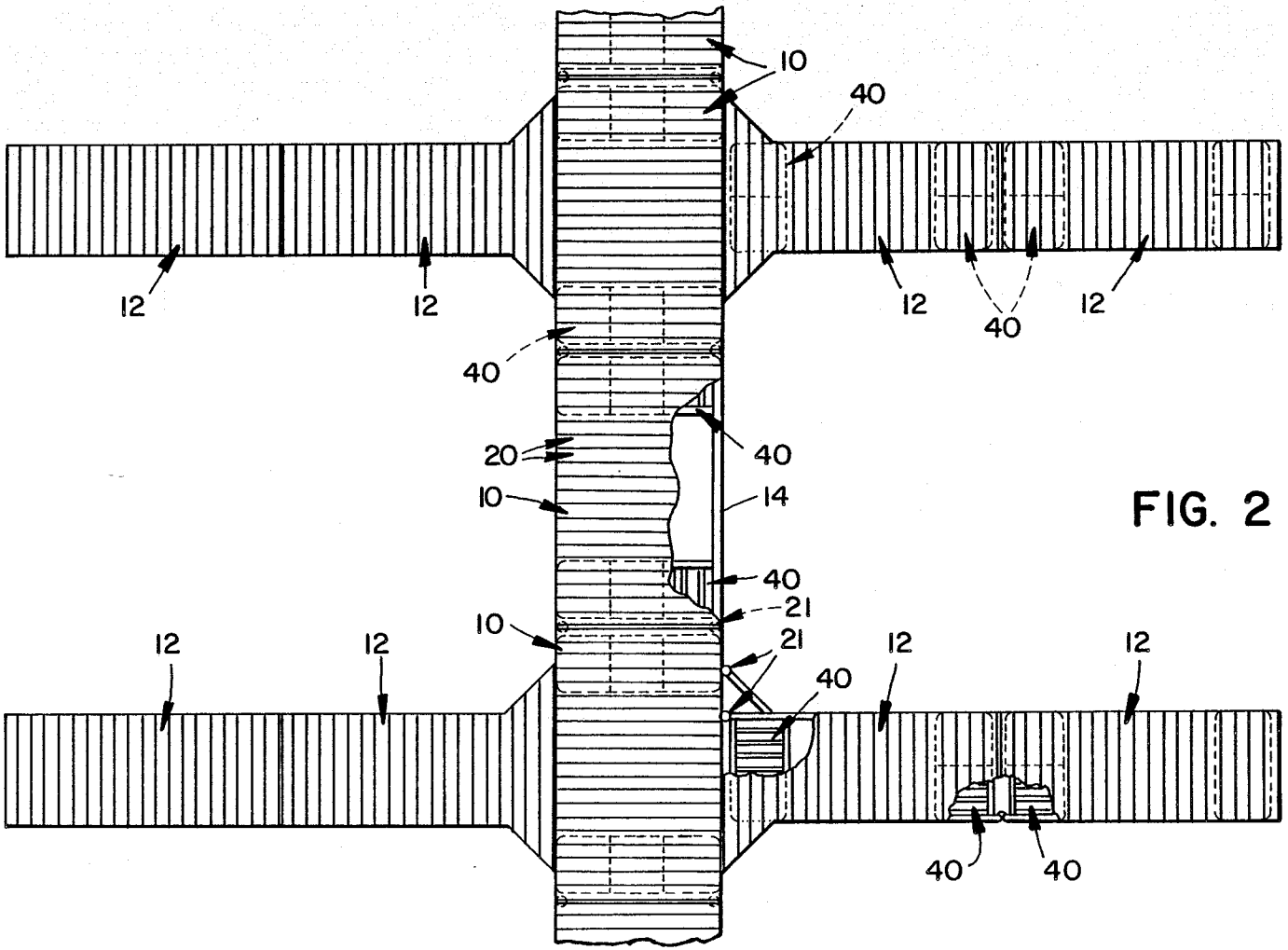
FIG. 2 is a schematic, plan view of a portion of a floating dock structure.

Referring now to the drawings wherein the showings are for the purpose of illustrating preferred embodiments of the invention only and not for the purpose of limiting same, there is shown in FIGS. 1 and 2 a floating main dock section 10 and a finger pier section 12 connected to main dock section 10. Preferably main dock section 10 and finger pier section 12 are supplied in kit form and assembled in the desired configuration by the user with one end of one of the main dock sections 10 appropriately secured to ground. Main dock section 10 comprises at least two longitudinally extending stringers 14. Stringers 14, preferably as shown in FIG. 1, are C shaped metal channels preferably galvanized or otherwise coated to resist rust and corrosion from the elements. Each stringer has a plurality of apertures spaced at regular intervals on its top, bottom and side surfaces so that a variety of appliances and appendices can be attached thereto. It should be appreciated that other structural steel forms can be used for stringers 14 and that stringers 14 need not be manufactured from steel. For example, wooden 2×6's could adequately function as stringers for a number of floating dock applications. The width of the dock section is determined by cross-braces 17 which, when supplied in a kit form, are channels secured by fasteners 18 to the bottom of stringers 14. For very wide dock sections 10, a third stringer can be provided with appropriate cross-braces 17 tying all three stringers together. A plurality of slats 20, typically wooden and treated with a wood preservative, are secured to the top of stringers 14 by conventional fasteners 22. Slats 20 and cross-braces 17 tied to stringers 14 thus provide a rigid box structure.

Various appliances can be provided with the dock kit. If desired, main dock section 10 can be provided with an electrical raceway, not shown, secured to the underside of slats 20 or to the inside of stringers 14. As shown in FIG. 1, if a finger pier 12 is not provided with main dock section 10 or is only provided adjacent one of stringers 14, a wooden bump board 24 secured by appropriate spacer clamps 25 to the outer surface of stringers 14 can be provided for boat docking purposes. Other appliances such as pipe support brackets 33 can be secured to stringers 14 for purposes which will hereafter be explained.

Main dock sections 10 are connected by hinge means 21 to one another. The hinged means 21 shown in FIG. 1 includes a conventional connector plate 28 which is formed with two trunnions 29 which receive therebetween the trunnions 29 of the connector plate 28 on the opposing dock section. A pin 30 dropped through trunnions 29 pins connector plate 28 of one dock section to connector plate 28 of the adjacent dock section. Fasteners 31 secure connector plate 28 at each end of each stringer 14 so that each main dock section 10 has four connector plates for effecting the described hinge connection. Alternative hinge joint connections can be provided and specifically, the universal hinged joint which permits dock sections to float above and below the level of adjacent dock sections 10 shown schematically in FIG. 8 and described in my prior application, Ser. No. 859,922, filed May 5, 1986, entitled "HINGE CONNECTOR FOR FLOATING DOCK" (now U.S. Pat. No. 4,683,833 which issued Aug. 4, 1987), can be substituted for connector plate 28 and my prior patent application is hereby incorporated by reference herein. Connector plate 28 or the hinge connector described in my prior application can be employed on the outside of stringer 14 for securing a finger pier section 12 as shown in FIGS. 1 and 2 to a main floating dock section 10.

Generally, finger pier sections 12 are narrower than main dock sections 10 and utilize a more simpler structure which may comprise simply a pair of stringers 14 secured by connector plates 28 to main dock section 10 with wooden slats 20 fastened to the top of stringers 14 to form the basic structure of finger pier 12.

Main dock section 10 is supported by a modular float drum assembly 40 and a modular float drum assembly 40 is also used to float finger pier section 12. Modular float drum assembly 40 comprises in its simplest form, at least two end float drum modules 42 and, depending upon the width of the dock section, any number of intermediate float drum modules 44 placed in between end float drum modules 42. The exact composition of any modular float drum assembly 40 is thus directly related to the width of the floating dock section. As shown in FIG. 1, modular float drum assembly 40 for finger pier section 12 simply comprises two end float drum modules 42 joined together and secured to the underside of stringers 14 so that wooden slats 20 across the top of finger pier stringers 14 and modular float drum assembly 40 positioned beneath finger pier stringers 14 rigidize the entire finger pier dock section 12. Modular float drum assembly 40 used in floating dock main section 10 illustrated in FIG. 1 comprises two end float drum modules 42 with an intermediate float drum module 44 placed in between end float drum modules 42. Assuming standard sized modules of two feet in width, finger pier section 12 would be four feet wide and main floating dock section 10 would be six feet wide. The exact position and number of modular float drum assemblies 40 used to float any given dock section is calculated on the basis of the "dead" or constant weight of the dock section to which is added the "live" weight or temporary load expected to be placed on the dock section. Generally speaking, at least two modular float drum assemblies 40 are used for each dock section with a modular float drum assembly positioned adjacent each end of the dock section.

Referring now to FIGS. 3–6, the float drum modules 42, 44 are molded from polyethylene by means of a special process (described in the patents noted above which are incorporated herein by reference) which essentially inject layers of polyethylene into a mold rotated in three dimensions or directions to permit the formation of intricately configured polyethylene wall sections uniquely suited for forming the container configuration of float drum modules 42, 44 described herein. Utilizing the fusion molding techniques described in such patents, it is possible to construct a mold where the parting line can be positioned at thin wall sections where significant loading stresses may occur such as on the flange end wall sections subsequently described below.

Common to each float drum module, 42, 44, is a top wall 47, a bottom wall 48, and contiguous with one another and top and bottom walls 47, 48 are first, second, third and fourth side walls 50, 51, 52 and 53 respectively which defines a sealed enclosure 55 contained therein. While various enclosure configurations 55 could be used, it is specifically contemplated that all enclosures 55 will be box-like in configuration, a shape that readily lends itself to being built into the dock-like structures which float drum modules 42, 44 will support. As noted above, enclosure 55 can be either air filled or foam filled, preferably with styrofoam.

With respect to the orientation of float drum modules 42, 44, each float drum module has a length dimension corresponding to the distance of one of the sides of float drum module 42, 44 which is indicated by the letter "L" in the drawings and which extends along the width of dock sections 10, 12. Each float drum module 42, 44 has a width indicated by the letter "W" on the drawings which corresponds to the end distance and which is orientated to extend along a longitudinal length of dock sections 10, 12. Finally, each floating drum module 42, 44 has a depth or height distance shown by the letter "H" in the drawings. Preferably each float drum module 42, 44 has a width of two feet, a height of approximately 17 inches and a length of two feet, except that it is contemplated that certain intermediate float modules 44 may be molded with a length of only 1 foot. Thus, for purposes of shipping any float drum module 42, 44, as a parcel package, the maximum parcel dimension will equal a length of 24 inches plus a girth of 82 inches (24 inches plus 17 inches plus 24 inches plus 17 inches) to equal 106 inches which falls just under the 109 inches specified by United Parcel Service (UPS) for delivering parcel packages. In practice, an address label is affixed to a float drum module 42, 44 and the float drum modules 42, 44 are shipped as loose pieces at a cost significantly less, for say two end modules 42 and an intermediate module 44, than the shipping freight for one prior art polyethylene float drum.

The peripheral configuration of top wall 47 of each float drum module 42, 44 is that of a parallelogram and preferably either square or rectangular. Adjacent the sides of top wall 47 and extending the length of each float drum module 42, 44 is a load bearing, rigidizing side flange 57 which is shown in cross sectional configuration in FIGS. 6 and **6*a*, there being two side flanges per float drum module 42, 44. While side flange 57 could be molded as a one-piece wall 57 about $\frac{5}{8}''$ in thickness, in the preferred embodiment, side flange 57 is actually formed from two wall sections, namely, a flat top wall section 59 which is adjacent and contiguous with top wall 47 and a flat bottom wall section 60 which is adjacent and contiguous with either first side wall 50 or second side wall 52 of float drum module 42, 44. Top wall section 59 and bottom wall section 60 are spaced apart from one another by edge wall section 61. At least one aperture 63 is provided in side flange 57 and is best shown in FIG. 6*a*. Aperture 63 is formed by an intermediary wall section 64 generally parallel to edge wall section 61 and contiguous with top and bottom wall sections 59, 60. Intermediary wall section 64 further strengthens side flange 57. The thickness of wall sections 59, 60, 61 and 64 are in practice approximately between $\frac{1}{8}''$ to $\frac{3}{8}''$. The particular configuration of side flange 57** is somewhat similar to side flange configurations used in prior art polyethylene float drums.

Figure 7:
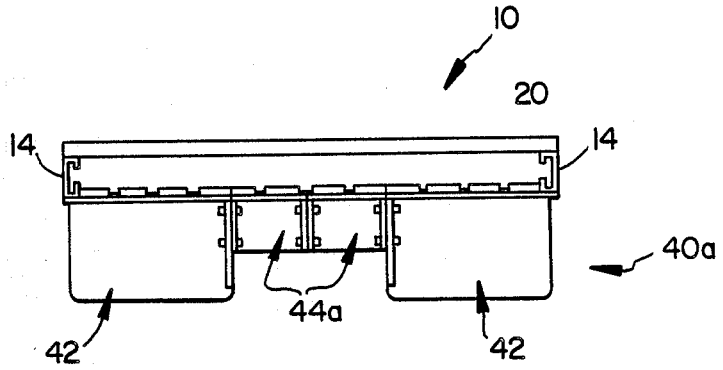
FIGS. 7, 7*a*, 7*b* and 7*c* illustrate various modular float drum assemblies.
Figure 7A:
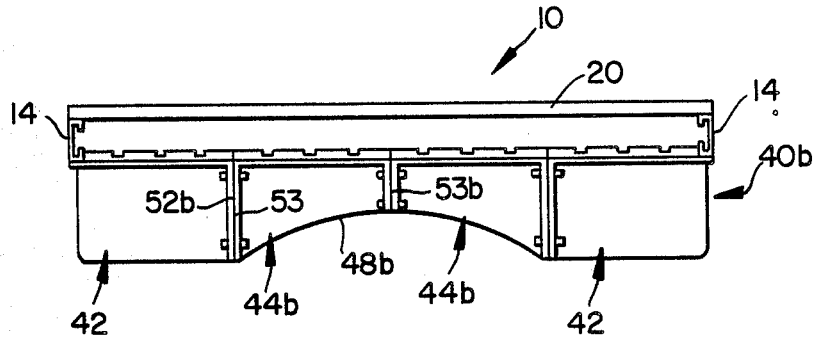
Figure 8:
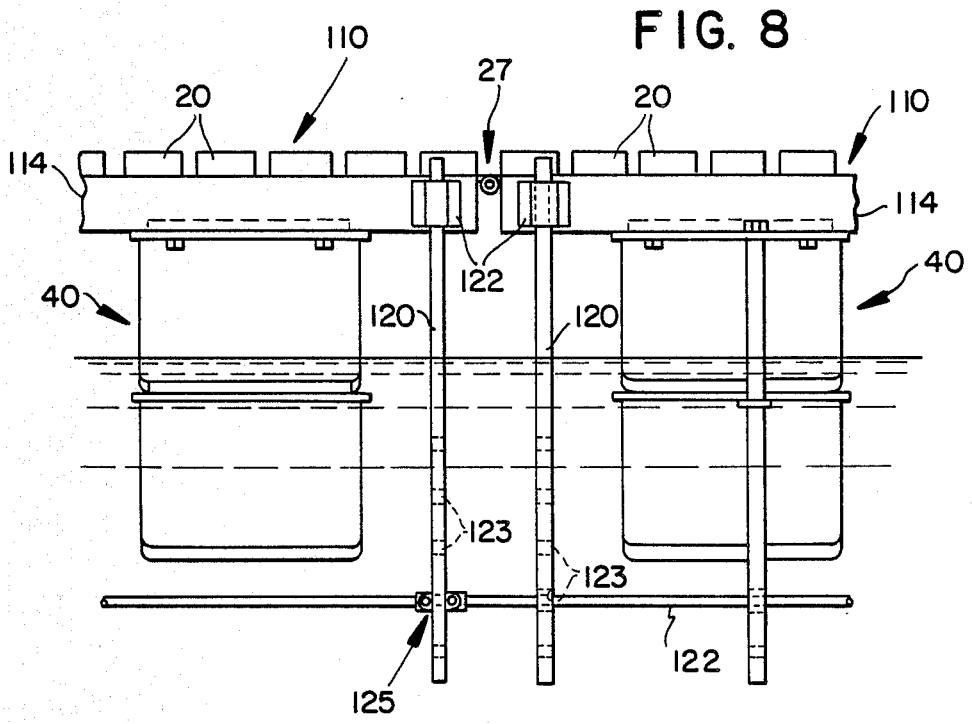
FIG. 8 is a schematic elevation view showing floating structures supported by a modular float drum arrangement tied to one another.
Figure 9:
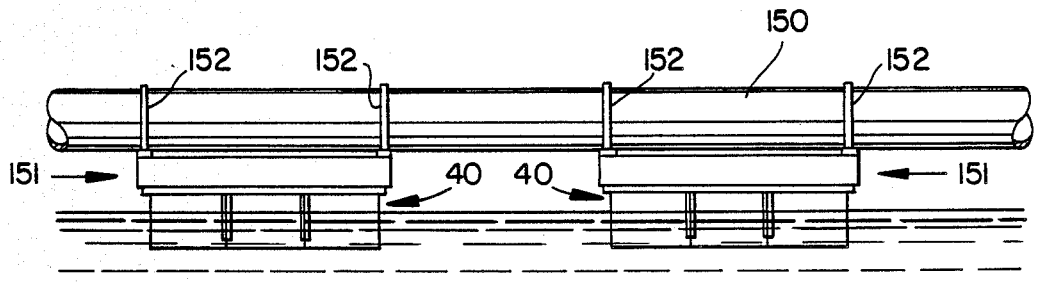
FIG. 9 is a schematic illustration of a further application of the modular float drum assembly to a floating structure.

The configuration of top wall 47 of float drum modules 42, 44 is somewhat similar to the configuration of bottom wall 48 and in the preferred embodiment as shown in FIGS. 3, 4, 5 and 6 includes a plurality of first and second channel shaped ribbed wall sections, 70 and 71 respectively, which extend from flat top wall sections 59 of side flange 57, run the width of top wall 47 parallel to one another, and are alternately spaced at regular intervals. Both first and second ribbed sections 70, 71 are raised with respect to top wall section 59 with first ribbed section 70 being higher than second ribbed section 71. In the preferred embodiment illustrated, the length or spacing of first ribbed section 70 is approximately 4–4 $\frac{1}{2}$ inches, the length or spacing of second ribbed section 71 is approximately 1 $\frac{1}{2}$ inches, and the height of first ribbed section 70 is approximately 1 inch whereas the height of the second ribbed section 71 is approximately $\frac{1}{4}$ of an inch. A similar channel shaped, third and fourth ribbed section 72, 73 is utilized on bottom wall 48. The length of fourth ribbed section 73 (i.e., the distance between adjacent third ribbed sections 72) is equal to the length of second ribbed section 71 of 1 ½ inches but the length of third ribbed section 72 (i.e., the distance between adjacent fourth ribbed section 73) is different than the length of first ribbed sections 70 to produce a staggered rib arrangement for load strengthening reasons. The height of third and fourth ribbed sections 72, 73, respectively, is equal to the height of first and second ribbed sections 70, 71. Alternative arrangements of first and second ribbed sections 70, 71 are illustrated in FIGS. 7, 8 and 9. In the alternative embodiments, the length or spacing of first, second, third and fourth ribbed sections 70c, 71c, 72c, 73c are equal and the spacing of third and fourth ribbed sections 72c, 73c on bottom wall 48c may or may not be offset with respect to the spacing of first and second ribbed sections 70c, 71c on top wall 47c to permit nesting or stacking modules 42c, 44 on top of one another in an interlocking fashion. A further modification would be to reduce the height of second and fourth ribbed sections 71, 73 co-planar with side flanges 57.

First and second side walls 50, 51 which extend from and are contiguous with the sides of bottom wall 48 and with bottom wall section 60 of side flange 57 also have third and fourth channel shaped ribbed sections 74, 75 which are a continuation of third and fourth ribbed sections 72, 73, respectively, on bottom wall 48. Thus the staggered relationship of third and fourth ribbed sections 73, 74 on bottom wall 48 relative to top wall 47 is continued on first and second side walls 50, 51 to provide an offset columnar support which maintains the rigidity of float drum modules 42, 44 when top wall 47 is loaded by dock structures 10, 12.

The configuration of third side wall 52 for the end float drum modules 42 which is at one end of top and bottom walls 47, 48, an end flange 77 identical to side flange 57 is provided. End flange 77 also has a top wall section 78, a bottom wall section 79 and an edge wall section 80, each end flange wall section, 78, 79, 80, is identical to, aligned with and contiguous with their respective counterparts of side flange 57. At least two apertures 82 are formed in end flange 77 for securing end float drum module 42 to a stringer 14. Fifth and sixth channel shaped ribbed wall sections 84, 85, respectively, are also formed in third side wall 52 of end float drum module 42 with the distance between adjacent fifth ribbed wall sections 84 which defines sixth ribbed wall sections 85 maintained at approximately 1 ½ inches which is the distance of second and fourth ribbed sections 73, 75. Further, one of the first ribbed sections 84 of third side wall 52 of end float drum module 42 extends about the intersection of third side wall 52 with first side wall 50 and at the intersection of second side wall 51 with third side wall 52. By configuring the top and bottom walls, 47, 48, the first and second walls 50, 51 of all float drum modules 40, 42 and third side wall 52 of end float drum module 42 with first and second, third and fourth, fifth and sixth ribbed sections, 70, 71, 72, 73, 74, 75, 84, 85 and tying such sections into a double walled side flange 57 and, for end float drum modules 42, a double walled end flange 77, a very rigid float drum module 42, 44 is obtained which will resist deformation when applied to a floating structure and which will be better able to withstand impacts from objects in the waterway. Additionally, by maintaining the spacing or length of second, fourth and sixth ribbed sections 71, 73, 75, 85 at 1 ½ inches, additional load bearing surfaces are provided which can snugly receive or grip structural lumber such as standard sized 2×4s, 2×6s, etc. for additional bracing as well as standard sized structural steel shapes such as channels, I-beams and the like. When float drum modules 42, 44 are secured together (in a manner which will be described next) into a modular float drum assembly 40, the rigidity of each float drum module 42, 44 supports one another in an additive effect so that the rigidity of the modular float drum assembly 40 is increased, thus providing a contiguous load bearing peripheral flange comprised of side flange 57 and end flanges 77.

Figure 3:
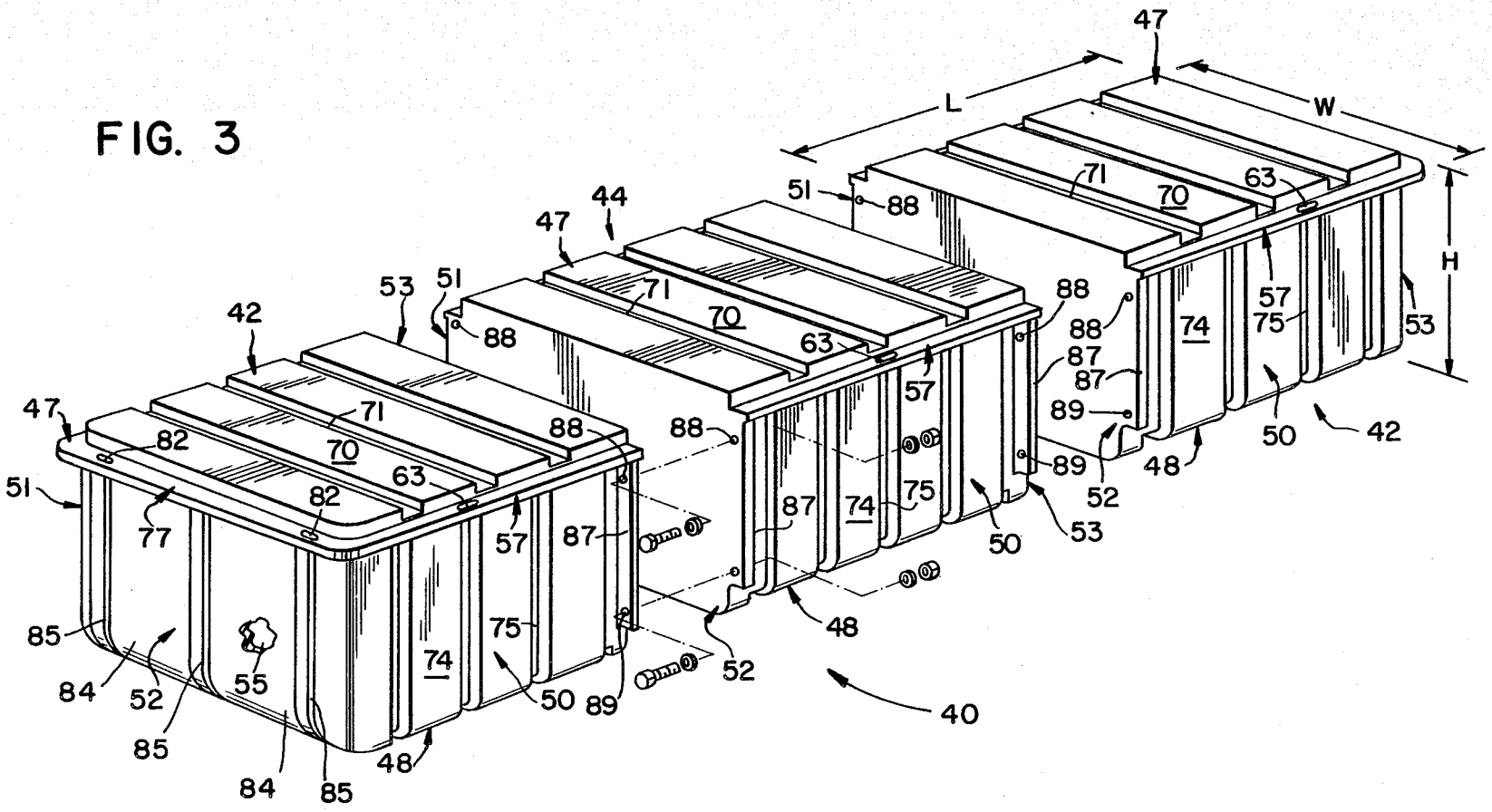
FIG. 3 is an enlarged exploded perspective view of a typical modular float drum assembly showing the float drum modules and their fastening means secured to one another.
Figure 4:
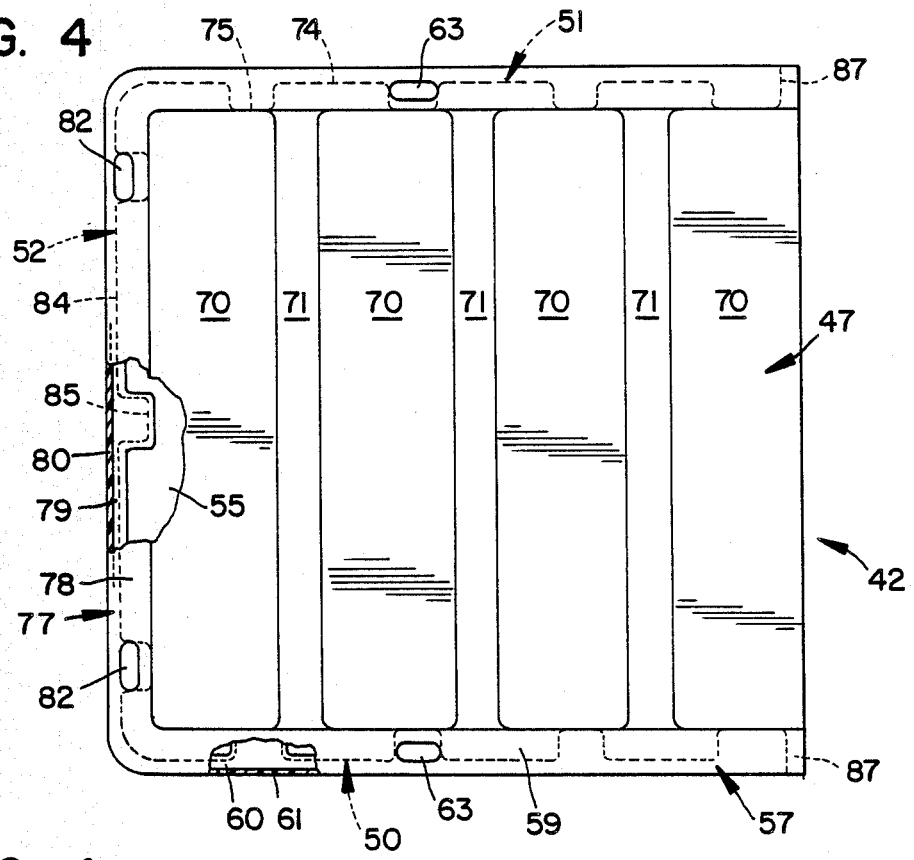
FIGS. 4 and further enlarged 4*a* are top and side views, respectively, of an end float drum module.
Figure 4A:
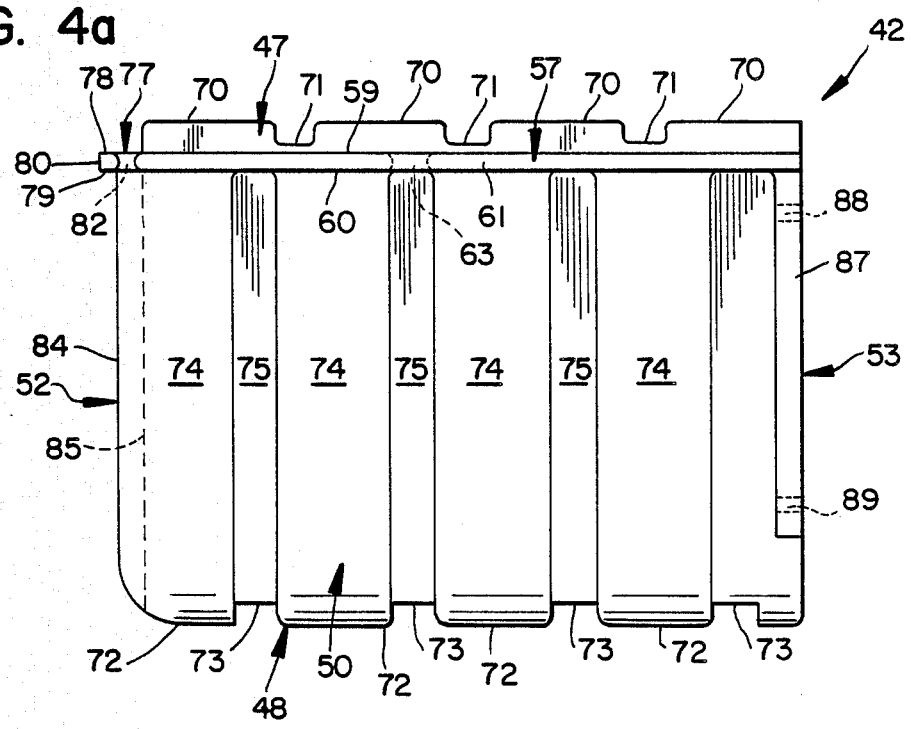
Figure 5:
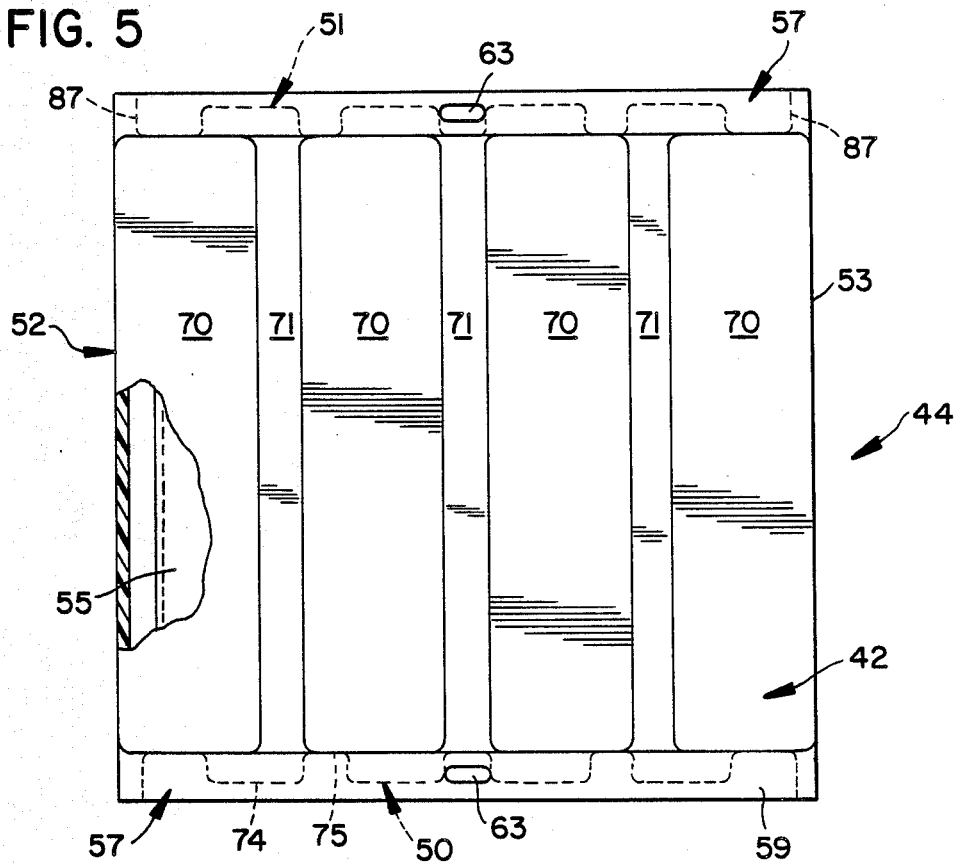
FIGS. 5 and 5*a* are top and side views, respectively, of an intermediate float drum module.
Figure 5A:
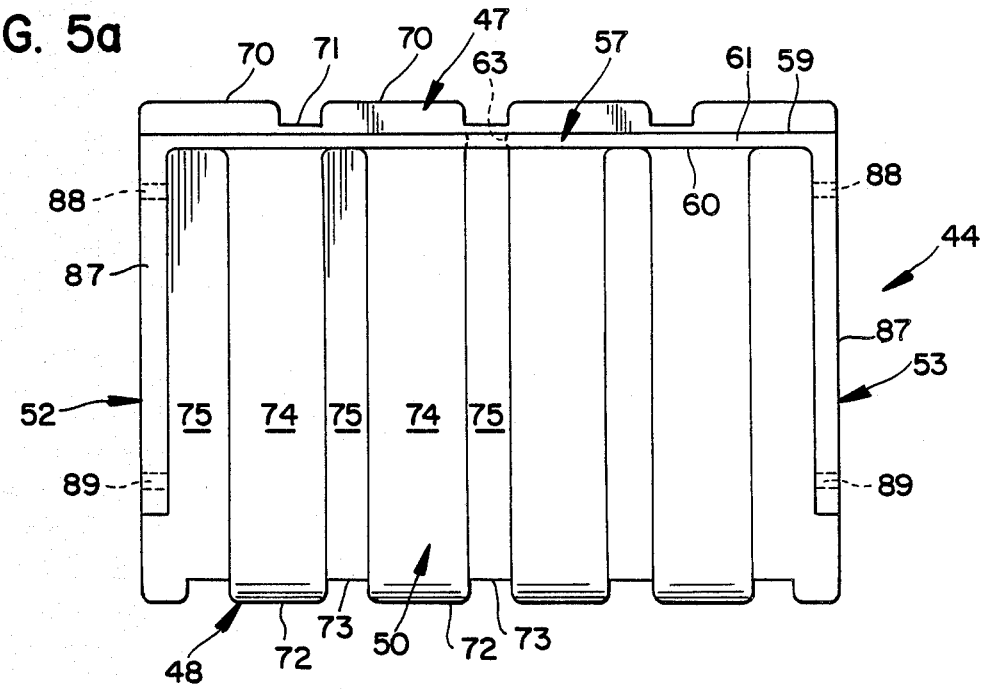

The fourth side wall 53 for all float drum modules 42, 44 and the third side wall 52 of intermediate float drum modules 44 are formed, in the preferred embodiment, as entirely flat surfaces extending substantially perpendicular to top and bottom walls 47, 48. Means are provided for connecting adjacent modules 42, 44 to one another by bringing adjacent flat third and fourth side walls 52, 53 of modules 42, 44 into co-planar relationship with one another by the use of conventional fasteners and the like. In the preferred embodiment, the fastening means as best shown in FIG. 3 includes a rib 87 formed at the intersection of first side wall 50 with fourth side wall 53 and second side wall 51 with fourth side wall 53 for all float drum modules 42, 44 and, in addition, at the intersection of first side wall 50 with third side wall 52 and second side wall 51 with third side wall 52 for intermediate float drum modules 44. The construction of rib 87 is identical at each designated intersection. Rib 87 extends approximately the total depth of side walls 50–53 and extends from edge wall section 61 of side flange 57 to second ribbed section 71, a distance of approximately 1 ½ inches with the thickness of the rib tapering slightly from approximately ¾ of an inch at side flange 57 to about ⅝ of an inch in accordance with sound molding practice. At least two apertures 88, 89 are provided for the insertion of conventional fasteners, the fasteners being applied by conventional hand tools. Alternative embodiments could include simply the formation of protrusions at the designated intersections through which apertures 88, 89 could be provided or, should a more rigid structure be desired, rib 87 could be extended beyond side flange 57 and appropriately braced by flanges against deflection to provide a larger flat bearing surface to insure a co-planar relationship between adjacent modules 42, 44. Alternatively, a double walled rib construction similar to side flange 57 could be provided. It is an important aspect of the invention that there be a substantially flat surface area between float drum modules 42, 44 which are to be securely and firmly fastened together so that adjacent module side walls confront each other in a co-planar or face-to-face or line-to-line relationship without any significant gap therebetween. By securing an accurate alignment of float modules 42, 44 into a modular float drum assembly 40, several advantages over prior art singular polyethylene float drums are achieved. A continuous side flange-end flange arrangement for the entire modular float drum assembly 40 results enabling crossbraces 17 to be secured over the entire length of side flange 57 which now spans several float drum modules 42, 44 in a modular float drum assembly 40 which extends across the entire width of dock section 10, 12. In this manner, stringers 14 are securely boxed and rigidized by slats 20 on the top surface and the modular float drum assembly 40 on the bottom surface thereof. Additionally, by avoiding the spacing which heretofor would exist for wide dock sections employing singular polyethylene float drums at the ends or edges thereof, a full face float is provided which acts not only as a "break wall", but as a means to uniformly transmit to the dock structure or any structure supported by the modular float drum assembly 40 the wave force thus minimizing the bending or couple forces exerted on the structure in the past. A still further benefit resulting from the more even distribution of the stresses to the dock structure from modular float drum assembly 40 is the fact that adjacent dock sections tend to more readily maintain the same elevation in the water despite the wave swells passing underneath, thus providing a more stable walkway to the user. While such benefits can be traced in good part to the co-planar relationship existing between adjacent float drum modules 42, 44, several modifications may be made to adjacent confronting side wall surfaces while maintaining the desired co-planar relationship. For example, adjacent flat third and fourth side walls 52, 53 could have ribbed sections or indentations formed therein to provide additional rigidity to each float drum module 42, 44 so long as a substantially flat surface area remained. Furthermore, at least for module float drum assemblies 40 employing one intermediate float drum module 44, the ribbed sections could be formed in the shape of a key way so that one module would slide into locking engagement with the appropriate key way formed in the wall of the adjacent module and sufficient flat bearing areas could be formed in the key way and in the fastening rib 87 to maintain the desired co-planar relationship.

FIGS. 7 and *7a* illustrate alternative embodiments of modular float drum assembly 40. In the preferred embodiment, the depth of end float drum modules 42 and intermediate float drum modules 44 are the same and, as noted, are approximately 17 inches. The preferred embodiment is the least expensive, easiest manner to float a dock structure comprising main dock sections typically between 6 and 10 feet in width and finger pier sections typically between 4 and 6 feet in width. A sufficient number of modular float drum assemblies 40 are positioned under sections 10, 12 (typically only at the ends of dock sections 10, 12) and because of the hinge means securing dock sections 10, 12 together, a sufficiently buoyant dock structure will result which will be maintained at an appropriate elevation out of the water despite variable live loadings at the ends of slats 20 which will be encountered such as when two or more people are walking past each other or are walking side by side on main dock section 10. In certain applications, principally those involving relatively wide main dock sections 10 such as dock sections 12 feet in width or wider, live weight loadings transmitted near the ends of slats 20 or at the edge of the width of the dock such as that which may occur when passengers exit a boat tied to the main dock section or when a number of people are walking near the edge of the dock in use, the ends of slats 20 may dip into the water even though the dock sections are rigidly connected to resist yewing or tipping. The modification illustrated in FIG. 7 is designed for wider dock sections and utilizes intermediate float drum modules 44*a* which have a depth of approximately one-half that of end float drum modules 42. Thus the modular float drum assembly 40*a* illustrated in FIG. 7 possesses an inherently greater buoyancy capacity at the ends of slats 20 or at the ends of the dock width to prevent dock section 10 from pitching or yewing into the water if live weight loading occurs at the ends of slats 20. At the same time, because intermediate drums 44*a* are interconnected to end drums 42, a rigid float structure is provided which has sufficient buoyancy when the buoyancy of each module 42, 44*a* is added to suspend and maintain the entire dock structure out of the water. Further, while intermediate float drum module 44*a* shown in FIG. 7 is described as being approximately one-half the depth of end modules 42, the same functional result could occur by using intermediate float drum modules 44 having the dimensions of the preferred embodiment and providing special end drum modules 42 having a greater depth than the 17 inch standard depth shown for the preferred embodiment of end float drum modules 42.

FIG. *7a* illustrates a further modification of a modular float drum assembly 40*b* of the concept illustrated in FIG. 7. In FIG. *7a*, intermediate float drum modules 44*b* have a third side wall 52*b* equal in depth to the fourth flat side wall 53 of end float drum modules 42 and intermediate float drum modules 44*b* have a fourth side wall 53*b* which has a lesser depth, preferably one-half, than third side wall 52*b*. The bottom wall 48*b* of intermediate float drum module of 44*b* tapers from third side wall 52*b* to fourth side wall 53*b* preferably as a curved, concave surface. In the alternative embodiment of FIG. *7a* the buoyancy force is thus highest at the ends of the dock width and then gradually is reduced to the midpoint of the dock to provide a more stable arrangement than that disclosed in FIG. 7 while still maintaining the ability to resist elevational changes resulting from live weight loading position at the width edges of the dock.

FIG. *7b* illustrates still another alternative embodiment showing a modular float drum assembly 40*c* structured to compensate not only for live weight loadings placed at the dock's edge, but also for additional "dead" weight loadings on dock sections 10. As discussed in the description of the dock sections 10, 12 illustrated in FIG. 1, pipe support brackets 33 and the like are conventionally fastened to the outside of stringers 14 for purposes of supporting additional structures such as lights, railings and the like which add additional dead weight concentrated at the edges of dock section 10. In the embodiment of FIG. *7c*, the "dead" weight loading is compensated for by stacking end float drum modules 42 one on top of the other. While end float drum modules 42 and intermediate float drum modules 44 having the ribbed section design shown in the preferred embodiment can be utilized in the arrangement illustrated in FIG. *7b*, for purposes of explaining the alternative embodiment, first, second, third and fourth ribbed sections 70*c*, 71*c*, 72*c*, 73*c* for end float drum modules 42*c* have the same dimensional length or spacing so that bottom wall 48*c* of one end float drum module 42*c* can nestingly receive top wall 47*c* of another end float drum module 42*c*. When viewed in the nesting relationship, it can be seen that second and fourth ribbed sections 71*c*, 73*c* are actually transversely extending recesses receiving transversely extending first and third ribbed sections 70*c*, 72*c*. Preferably, ribbed wall sections 70*c*, 71*c*, 72*c*, 73*c* are approximately 1 ½ inches in width so that end float drum modules 42*c* retain their ability to nestingly receive standard structural shapes between first and second ribbed wall sections 70*c*, 71*c* for cross-bracing purposes. Several different joining means are shown in FIG. *7b* for securing end float drum modules 42*c* in a vertical stacked relationship. The joining means could comprise a threaded fastener rod 100, preferably plastic, which is inserted through overlying apertures 63c in side wall flange 57c of end float drum modules 42c and fastened by appropriate retaining nuts 101. Alternatively, and as best shown in FIG. 6a, the end float drum module 42c can be formed with tubular wall section 96 which extends the depth of end float drum module 42c to provide further rigidity to end float drum module 42c. Preferably, tubular wall section 96 is adjacent or terminates at an opening 97 in one of second ribbed sections 71c at top wall 47c and an opening in first ribbed section 72c at bottom wall 48c to define a tubular opening 99 extending through end float drum module 42. This configuration permits a rod 103 with threaded ends to be secured by retainer nuts 104 which do not extend above the height of first ribbed sections 70c in top wall 47c. When threaded rod 103 is used as a fastening means for securing together a stack of end float drum modules 42c, a tubular wall section 96 materially assists in the prevention of any skewing of the bottom end float drum module 42c with respect to the top end float drum module 42c while avoiding loading of the side wall flange 57c. It is contemplated that either fastening rods 100, 103 can extend a predetermined distance below the depth of the bottom end float module 42c. In such instance, a fastening pipe 106 can be provided with a fixed stop to engage bottom wall section 60c of side flange 57c of bottom end float drum module 42c and a threaded end adjacent top wall 47c of the top end float drum module 42c for securing the modules together while rod 106 has a bottom portion 108 extending a predetermined distance below bottom end float drum module 42c. A threaded rod (not shown) could then connect bottom portions 108 to function as a parallelogram and rigidize the dock side-to-side.

Figure 7B:
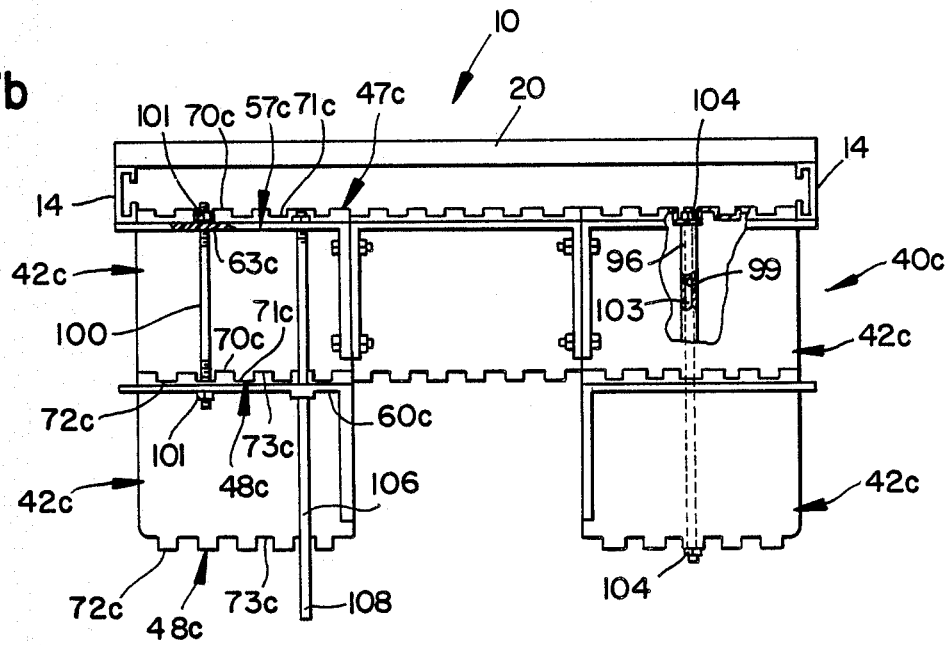
Figure 7C:
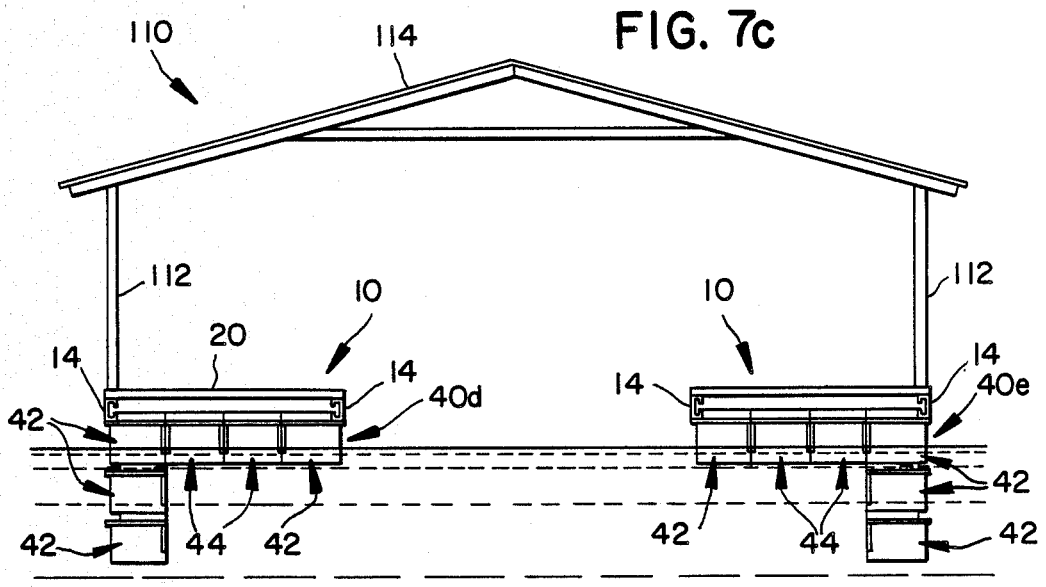

While FIG. 7b illustrates stacking two end float drum modules 42c, one on top of the other, a plurality of end float drum modules could be stacked in this manner solely as a function of the dead weight of the structure to be secured by main floating dock structure 10. Thus, as shown in FIG. 7c a boathouse 110 could be supported by floating main dock sections 10 with a modular float drum assembly 40 such as shown at 40d or 40e positioned underneath the point where a support 112 is secured to a stringer 14 on main dock sections 10 to support the roof 114 of boathouse 110. The number of end float drum modules 42 to be stacked on top of one another would be determined by the weight of roof 114 and any additional weight such as snow which might be applied to roof 114 while maintaining the elevation of main dock sections 10 at a level attitude in the water.

FIG. 8 illustrates a further modification to a conventional floating dock structure which is sometimes utilized to prevent skewing of adjacent dock sections while also providing additional structural rigidity by tying adjacent main dock float sections 112 together. In this type of construction, a rigidizing mechanism is utilized which includes a stabilizing pipe 120 secured at one end to a clamp plate 122 in turn secured to a stringer 114 either in a fixed or alternatively a pivotal manner. The opposite ends of stabilizing pipe 120 extend into the water for a predetermined distance and are secured to rigidizing rod 124 which extends in a longitudinal direction parallel to stringer 114. Rigidizing rod 124 either passes through elongated openings 123 in stabilizing pipe 120 or is secured to stabilizing rod 120 by a clevis arrangement 125 so that some unrestricted longitudinal movement between stabilizing pipe 120 and rigidizing rod 124 is permitted. Conceptually, stringers 114, stabilizing pipe 120, and rigidizing rod 124 form a parallelogram tending to prevent skewing of adjacent dock sections 112 by transmitting loads from one dock section to another dock section while still permitting some relative movement between adjacent dock sections through the hinge connecting mechanism 27. It is contemplated that with end float drum module 42 modified so that either fastening rods 103, 106 shown in FIG. 7b pass through the end flanges 77 thereof could be secured to rigidizing rod 124. Conceptually fastening rods 103, 106 could replace stabilizing rods 120.

While modular float drum assembly 40 has been thus far described with specific reference and application to a floating dock structure, there are other applications suitable for a modular float drum assembly 40 application. In FIG. 9 a floating dock structure is used to carry a pipeline 150 across a body of water. A plurality of swim float-like structures 151 is provided with each swim float structure 151 basically comprising a rectangular frame housing two modular float drum assemblies 40g. A circular pipe clamp 152 is secured to the rectangular frame at each end of the frame. Pipe clamp 152 pins pipe line 150 to at least two points on swim float 151 thus providing a means for supporting pipe line 150 at discreet spacings along its length as pipe line 150 spans the waterway. A still further application of the modular float drum assembly, not shown, could be its use as a breakwall. A breakwall could be constructed by connecting a plurality of intermediate float modules 44 to one another until the desired body of water was spanned. A plurality of structural steel members such as I-beams or a channel would then be interconnected to equal the length of the breakwall and secured to the top wall 47 of select float drum modules 44. The ends of the modular float drum assembly 40 (in this case the breakwall) and the ends of the connected structural steel assembly would then be fixed to pylons anchored in the water.

The invention has been described with reference to a preferred and alternative embodiment and it is apparent that many modifications may be incorporated into the design and configuration of the modular float drums disclosed herein without departing from the spirit or the essence of the invention. It is my intention to include all such modifications and alterations insofar as they come within the scope of my invention. It is thus the essence of my invention to provide a modular float drum assembly using float drum modules which can be readily adapted and configured to float a wide variety of structures in the waterway.

Having thus described the invention, it is now claimed:

1. A modular float drum assembly for use in supporting a floating structure comprising:

at least two one-piece, plastic molded float drum modules, each drum module having a top wall, a bottom wall and contiguous first, second, third and fourth side walls extending between said top and bottom walls to define a buoyant enclosure contained therein;

rigidizing means integrally formed in each module to rigidize each module against deformation, said rigidizing means including a generally flat first wall segment contiguous with said top wall, a generally flat second wall segment spaced a distance away from said first wall segment and contiguous with one of said side walls, and an end wall segment interconnecting said first wall segment with said second wall segment, said first and second wall segments having essentially identical openings formed therein and aligned with one another, and an interconnecting wall segment extending about at least a portion of the peripheral edge of said openings and also interconnecting said first and second wall segments whereby a double wall construction rigidizes said module when fasteners securing said module to said floating structure are applied through said openings; and module securing means formed in one of the side walls of each module for releasably joining one module to another module in an aligned relationship where the modules are in side-by-side physical contact with one another.

2. A modular float drum assembly for use in supporting a floating structure comprising:

at least two one-piece, plastic molded float drum modules, each drum module having a top wall, a bottom wall and contiguous first, second, third and fourth side walls extending between said top and bottom walls to define a buoyant enclosure contained therein;

rigidizing means integrally formed in each module to rigidize each module against deformation, said rigidizing means including a generally flat first wall segment contiguous with said top wall, a generally flat second wall segment spaced a distance away from said first wall segment and contiguous with one of said side walls, and an end wall segment interconnecting said first wall segment with said second wall segment, whereby a double wall construction rigidizes said module; and module securing means formed in one of the side walls of each module for releasably joining one module to another module in side-by-side aligned relationship, said module securing means including rigidizing means formed in adjacent side walls whereby a double wall construction is provided.

3. A plastic float drum module for use in supporting a floating dock structure comprising:

at least two one-piece float drum modules, each drum module having a top wall, a bottom wall and contiguous first, second, third and fourth side walls extending between said top and bottom walls to define a buoyant enclosure contained therein;

each module having first rigidizing means including generally flat first wall segments contiguous with the sides of said top wall, generally flat second wall segments spaced a distance away from said first wall segments and contiguous with two of said side walls depending from opposite sides of said top wall, and end wall segments, each end wall segment interconnecting a first wall segment with an adjacent second wall segment, whereby a double wall construction rigidizes each module; and second rigidizing means formed at least at one intersection of adjacent side walls of each module and having at least one opening extending through said adjacent side walls for releasably mating one module to another module in vertically aligned side-by-side relationship, said intersection having a double wall construction.

4. A modular float drum assembly for use in supporting a floating dock structure comprising:

at least first and second one-piece plastic molded float drums, each molded drum having a top wall, a bottom wall and contiguous first, second, third and fourth side walls extending between said top and bottom walls to define a buoyant enclosure contained therein;

rigidizing means integrally formed adjacent said top wall of each drum for securing said drums to said floating structure; and connecting means for releasably mating in side-by-side physical contact the face surface of one of said side walls of only said first drum with the face surface of one of said side walls of only said second drum whereby said molded plastic first and second drums can be joined with said top wall of said first drum being in generally the same plane as the top wall of said second drum.

5. A modular float drum assembly for use in supporting a floating structure comprising:

at least two one-piece float drum modules, each drum module having a top wall, a bottom wall and contiguous first, second, third and fourth side walls extending between said top and bottom walls to define a buoyant enclosure contained therein;

each drum module having a load bearing, rigidizing flange section at opposite sides of said top wall, said flange section including a generally flat top wall segment, a generally flat bottom wall segment, and a contiguous edge wall segment at the ends of said flange's top wall segment and bottom wall segment to provide a spacing therebetween whereby the rigidity of said float module is increased, said first side wall of said drum module spaced inwardly from at least a portion of said edge wall segment of one of said flanges and contiguous with said bottom wall segment of one of said flanges, said second side wall of said drum module similarly spaced inwardly over at least a portion of said edge wall segment of the other flange and contiguous with said bottom wall segment of said other flange; and module connecting means for releasably mating one of said side walls of one drum module with the same one of said side walls of another drum module, such that said one side wall is in substantial physical contact with said one side wall of said other module along the length thereof, whereby the modules are mated in a vertically aligned side-by-side manner.

6. A polyethylene float drum module for use in a modular float drum assembly to buoyantly support a structure comprising:

a box-like structure having a top wall, a bottom wall and contiguous first, second, third and fourth side walls defining a buoyant enclosure surrounded thereby;

said top wall having at two of its opposite sides a load bearing flange section, said flange section having generally flat top wall segments, generally flat bottom wall segments and contiguous edge wall segments therebetween at the ends of said flanges' flat wall segments to define a pair of rigid flange sections, each having a double wall segment, said top wall further defined by a plurality of channel shaped, alternately spaced, first and second ribbed sections formed in said top wall, said first ribbed sections extending above said flange's top wall segment a greater distance than said second ribbed sections;

said first and second side walls extending away from said top wall and intersecting said bottom wall, said first and second side walls having a plurality of channel shaped, alternatively spaced third and fourth ribbed sections extending from said flange section to said bottom wall whereby said module is rigidized by said ribbed sections and said side flange sections; and fastening means associated with one of said side walls to attach one module to another in a releasably mated, flange aligned, side-by-side relationship by bringing, the side wall of one module into confronting, physical contact with the side wall of another module.

7. A floating dock system comprising:

a main walkway including first and second longitudinally extending, generally parallel side stringers having a length approximately equal to the desired length of said walkway, at least one transversely extending cross-brace in between and secured to said stringers, a plurality of transversely extending slats secured to the top side of said stringers, means to secure one end of said stringers to ground to prevent said dock from floating away; and a modular float drum assembly secured to the bottom of said stringers to maintain said slats out of the water, said assembly including at least a first and second float drum module, each drum module having a ribbed top wall, sidewalls depending from said top wall, a rigidizing flange section at one end of said top wall, dock fastening means securing the bottom side of one stringer to said flange section of one drum module and the bottom side of the other stringer to said flange section of the other drum module, and module fastening means securing a side wall of one drum module to a side wall of the other drum module so that each of the joined side walls is in at least partial co-planar contact with one another in an aligned side-by-side relationship.

* * * * *